US010311823B2

(12) United States Patent
Yoon

(10) Patent No.: US 10,311,823 B2
(45) Date of Patent: Jun. 4, 2019

(54) LIQUID CRYSTAL DISPLAY DEVICE AND DRIVING METHOD THEREOF

(71) Applicant: SAMSUNG DISPLAY CO., LTD., Yongin-si, Gyeonggi-do (KR)

(72) Inventor: Hyun-Sik Yoon, Asan-si (KR)

(73) Assignee: SAMSUNG DISPLAY CO., LTD., Yongin-Si, Gyeonggi-Do (KR)

( * ) Notice: Subject to any disclaimer, the term of this patent is extended or adjusted under 35 U.S.C. 154(b) by 79 days.

(21) Appl. No.: 15/440,013

(22) Filed: Feb. 23, 2017

(65) Prior Publication Data

US 2017/0243557 A1 Aug. 24, 2017

(30) Foreign Application Priority Data

Feb. 24, 2016 (KR) ..... 10-2016-0022028

(51) Int. Cl.
*G09G 3/36* (2006.01)
*G09G 3/00* (2006.01)

(52) U.S. Cl.
CPC ..... *G09G 3/3688* (2013.01); *G09G 3/3677* (2013.01); *G09G 3/003* (2013.01); *G09G 2310/0205* (2013.01); *G09G 2310/0227* (2013.01); *G09G 2310/067* (2013.01); *G09G 2310/08* (2013.01); *G09G 2320/0209* (2013.01); *G09G 2360/12* (2013.01); *G09G 2360/18* (2013.01)

(58) Field of Classification Search
CPC .... G09G 3/3688; G09G 3/3677; G09G 3/003; G09G 2310/0205; G09G 2310/0227; G09G 2310/067; G09G 2310/08; G09G 2320/0209; G09G 2360/12; G09G 2360/18
See application file for complete search history.

(56) References Cited

U.S. PATENT DOCUMENTS

2008/0082413 A1* 4/2008 Madhavan ..... G06Q 30/02 705/14.53
2008/0104026 A1* 5/2008 Koran ..... G06F 17/30867
2009/0325484 A1* 12/2009 Lele ..... H04W 8/205 455/41.1

(Continued)

FOREIGN PATENT DOCUMENTS

KR 10-2002-0093814 12/2002
KR 10-2010-0128019 12/2010

(Continued)

*Primary Examiner* — Sahlu Okebato
(74) *Attorney, Agent, or Firm* — F. Chau & Associates, LLC

(57) ABSTRACT

A liquid crystal display includes a display unit having a plurality of pixels in a plurality of first rows and second rows that are alternately arranged. A gate driver supplies a same scan signal to a plurality of pixels of a first row and a second row that are adjacent to each other among the plurality of first rows of pixels and the plurality of second rows of pixels at a first frame period and a second frame period that are continuous. A plurality of scan signals are respectively supplied to the plurality of second rows of pixels at the second frame period. A data driver generates a plurality of data voltages respectively corresponding to the plurality of first rows of pixels at the first frame period and generating a plurality of data voltages respectively corresponding to the plurality of second rows of pixels at the second frame period.

20 Claims, 9 Drawing Sheets

(56) References Cited

U.S. PATENT DOCUMENTS

2016/0086581 A1* 3/2016 Khoury ..... G09G 5/14
345/1.2

FOREIGN PATENT DOCUMENTS

| | | |
|---|---|---|
| KR | 10-2015-0069413 | 6/2015 |
| KR | 10-2015-0093285 | 8/2015 |
| KR | 10-2016-0066131 | 6/2016 |

* cited by examiner

LIQUID CRYSTAL DISPLAY DEVICE AND DRIVING METHOD THEREOF

CROSS REFERENCE TO RELATED APPLICATIONS

This application claims priority to and the benefit of Korean Patent Application No. 10-2016-0022028 filed in the Korean Intellectual Property Office on Feb. 24, 2016, the entire contents of which are incorporated by reference herein.

BACKGROUND

1. Technical Field

The described technology relates generally to a liquid crystal display and a driving method thereof.

2. Discussion of the Related Art

A liquid crystal display includes a common electrode, a pixel electrode of each pixel, and a liquid crystal layer. A liquid crystal arrangement of the liquid crystal layer formed between the common electrode and the pixel electrode is controlled. For example, an amplitude and a phase of light emitted from a backlight depending on the liquid crystal arrangement that is controlled corresponding to each pixel is determined, and a plurality of lights corresponding to the plurality of pixels are combined, thereby realizing a display image.

The liquid crystal display includes a 3D liquid crystal display. In the 3D liquid crystal display, a 3D crosstalk phenomenon (in which a left eye image and a right eye image interfere with each other), may be reduced by displaying each frame configuring the image with a speed of 240 Hz or more.

However, when manufacturing a display panel having a charge rate characteristic that is optimized for the 240 Hz frame speed, a size of a thin film transistor (TFT) increases, and resultantly, a display area is reduced such that a transmittance reduction is generated.

Accordingly, when the display panel having a charge rate characteristic that is optimized for the 240 Hz frame speed is operated, it may be desirable to display the image at 240 Hz by applying a gate doubling driving method.

When using a conventional gate doubling driving method, the display speed of the frame is raised to 240 Hz by simultaneously driving two pixel rows. However, by simultaneously driving two pixels rows, a vertical resolution is reduced by half.

The above information disclosed in this Background section is provided only for enhancement of understanding of the background of the described technology and therefore it may contain information that does not form the prior art that is already known in this country to a person of ordinary skill in the art.

SUMMARY

Embodiments of the inventive concept provide a liquid crystal display and a driving method thereof that may increase the display speed of a frame and can minimize the resolution deterioration by using an amended gate doubling driving method.

A liquid crystal display according to an embodiment of the inventive concept includes a display unit including: a plurality of first rows of pixels and a plurality of second rows of pixels that are alternately arranged; a gate driver supplying the same scan signal to the plurality of pixels of a first row and a second row adjacent to each other from among the plurality of first rows of pixels and the plurality of second rows of pixels at a first frame period and a second frame period that are continuous, and respectively supplies a plurality of scan signals to the plurality of second rows at the second frame period; and a data driver generating a plurality of data voltages respectively corresponding to the plurality of pixels of the plurality of first rows at the first frame period and generate a plurality of data voltages respectively corresponding to the plurality of second rows at the second frame period.

The data driver may sequentially supply a first row data voltage corresponding to the pixels positioned at the plurality of first rows by a unit of the pixel row at the first frame period, and may sequentially supply a second row data voltage corresponding to the pixels positioned at the plurality of the second rows by a unit of the pixel row at the second frame period.

The gate driver may substantially simultaneously supply the scan signal to the pixels of the first row corresponding to the first row data voltage and the pixels of the second row adjacent to the first row at the first frame period, and may supply the scan signal to the pixels of the second row corresponding to the second row data voltage at the second frame period.

The pixels positioned at the plurality of first rows may maintain the first row data voltage at the second frame period.

The display unit may display a first frame image at the first frame period and a second frame image at the second frame period, and the first and second frame images may be overlapped to express (e.g. display) an original image, for example, in 3D.

The liquid crystal display may further include a timing controller that includes circuitry configured to convert an input image signal received from the outside into a data image signal to be supplied to the data driver, the data image signal may include a first data image signal corresponding to the first row data voltage and a second data image signal corresponding to the second row data voltage, and the timing controller may generate the second data image signal with reference to the first data image signal.

The timing controller may determine the second data image signal so that a sum of a luminance displayed corresponding to the first row data voltage and a luminance displayed corresponding to the second row data voltage becomes (e.g. results in) a luminance displayed by the original image at the second row pixel.

The timing controller may include a preprocessing logic to convert the input image signal into the data image signal of a format that is compatible with the data driver, a frame memory having a capacity to store the data image signal corresponding to at least one frame image, and a line correction logic that receives the first data image signal from the frame memory and corrects the second data image signal with reference to the first data image signal.

A driving method of a liquid crystal display according to an embodiment of the inventive concept may include: supplying, by a data driver, a data voltage corresponding to each pixel through a data driver by a unit of a pixel row; supplying, by a gate driver, a scan signal allowing input of the data voltage to the pixel by the unit of the pixel row; and displaying, by a display unit, a display image corresponding to the data voltage including a plurality of pixels at a plurality of first rows and second rows that are alternated, wherein the gate driver supplies a same scan signal to the plurality of pixels of the first row and the second row adjacent to each other from among the plurality of first rows of pixels and the plurality of second rows of pixels at the first frame period of the first frame period and the second frame period, and respectively supplies a plurality of scan signals to a plurality of pixels of the plurality of second rows at the second frame period, and the data driver generates a plurality of data voltages respectively corresponding to the plurality of first rows at the first frame period and generates a plurality of data voltages respectively corresponding to the plurality of second rows at the second frame period.

The operation of supplying the data voltage by the unit of the pixel row may include: sequentially supplying the first row data voltage corresponding to the pixels positioned in the plurality of first rows of pixels at the first frame period by the unit of the pixel row; and sequentially supplying the second row data voltage corresponding to the pixels positioned in the plurality of second rows of pixels at the second frame period by the unit of the pixel row.

The operation of supplying the scan signal by the unit of the row may include: substantially simultaneously supplying the scan signal to the pixel of the first row corresponding to the first row data voltage and the pixel of the second row adjacent to the first row at the first frame period; and supplying the scan signal to the pixel of the second row corresponding to the second row data voltage at the second frame period.

The pixels positioned in the plurality of first rows may maintain the first row data voltage during the second frame period.

The operation of displaying the display image corresponding to the data voltage may include: displaying a first frame image at the first frame period; and displaying a second frame image at the second frame period, wherein the first and second frame images may be overlapped to display an original image.

The driving method of the liquid crystal display may further include converting an input image signal received from the outside into a data image signal through a timing controller to be supplied to the data driver, wherein the data image signal may include a first data image signal corresponding to the first row data voltage and a second data image signal corresponding to the second row data voltage, and the timing controller may generate the second data image signal with reference to the first data image signal.

The timing controller may determine the second data image signal so that a sum of a luminance displayed corresponding to the first row data voltage and a luminance displayed corresponding to the second row data voltage results in a luminance displayed by the original image at the second row pixel.

A display device according to an embodiment of the inventive concept may include a plurality of gate lines and a plurality of data lines; a liquid crystal display including a plurality of pixels arranged in a plurality of first rows and second rows that alternate, and each pixel includes a switching element connected to one or more of the plurality of gate lines and one or more of the plurality of data lines; a gate driver may be configured to output a pair of adjacent rows of pixels via at least one of the gate lines a first scan signal comprising one of the first rows of pixels and one of the second rows of pixels to generate a first frame image at a first frame period, and the gate driver may be configured to output a second scan signal to one row of the pair of adjacent first and second rows of pixels to generate a second frame image; and a data driver that at the first frame period may generate a plurality of data voltages respectively corresponding to the plurality of first rows of pixels, and the data driver may generate at the second frame period a plurality of data voltages respectively corresponding to the plurality of second rows of pixels; and the data driver may supply, via the plurality of data lines, data voltages corresponding to the first and second rows of pixels.

At the second the second frame period, one row of the pair of adjacent rows of pixels may receive the second scan signal and generate the second frame image, and the other row of the pair of adjacent rows of pixels may maintain respective data voltages from the first frame period.

In the second frame period, the data driver may substantially simultaneously supply the data voltages to the pixels of the one row of the pair of adjacent first and second rows of pixels.

In the first frame period the gate driver outputs a respective scan signal to at least one other pair of adjacent first and second rows of pixels.

DETAILED DESCRIPTION

Figure 1A:
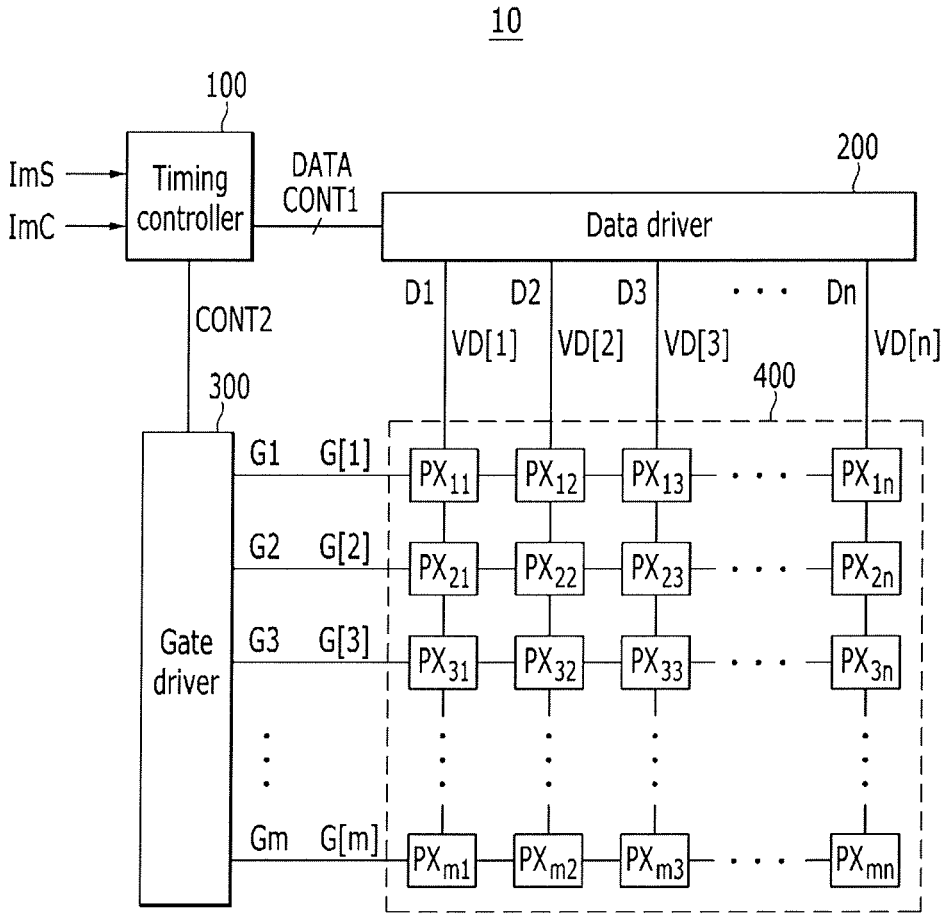
FIG. 1A is a schematic of a liquid crystal display according to an embodiment of the inventive concept.

The present disclosure describes the inventive concept more fully hereinafter with reference to the accompanying drawings, in which embodiments of the inventive concept are shown. As those skilled in the art would realize, the described embodiments may be modified in many different ways, all without departing from the spirit or scope of the present disclosure.

To clearly describe embodiments of the inventive concept, portions which do not relate to the description are omitted, and like reference numerals designate like elements throughout the specification. Accordingly, reference numerals for elements illustrated in a previous drawing may be used in a following drawing.

Further, the drawings are not to scale, thus, the size and thickness of each component shown in the drawings are arbitrarily shown for better understanding and ease of description, but the present disclosure is not limited thereto. In the drawings, the thickness of layers, films, panels, regions, etc., may be exaggerated for clarity.

Electrically connecting two elements includes not only directly connecting two elements but also includes, for example, connecting two elements with another element there between. The other element may include a switch, a resistor, a capacitor, etc.

FIG. 1A is a schematic of a liquid crystal display according to an embodiment of the inventive concept.

Referring to FIG. 1A,a liquid crystal display 10 according to an embodiment includes a timing controller 100, a data driver 200, a gate driver 300, and a display unit 400.

The timing controller 100, which includes circuitry configured for operation, receives an external input signal from an external graphics controller (not shown). The external input signal may include an input image signal ImS and an input control signal ImC.

The input image signal ImS includes luminance information of each pixel, and the luminance may correspond to a predetermined number, for example, 1024, 512, 256, 128, or 64 grays. The input image signal ImC may exist for each color such as red, green, blue, and the like. The input image signal ImS may be converted into a data image signal DATA that may be used in the data driver 200 depending on processing of the timing controller 100. The data image signal DATA may include a first data image signal corresponding to a first frame image and a second data image signal corresponding to a second frame image.

The first frame according to an embodiment of the inventive concept may be one of an odd-numbered and an even-numbered frame, and the second frame may be the other of the odd-numbered and the even-numbered frame. Hereinafter, the first frame is the odd-numbered frame and the second frame is the even-numbered frame.

The input control signal ImC may include a vertical synchronization signal, a horizontal synchronization signal, a main clock signal, a data enable signal, and the like. The input control signal ImC may be converted into a data control signal CONT1 and a gate control signal CONT2. The gate control signal CONT2 may include a scan signal, a scan start signal instructing a supply start of the scan signal, and a scan clock signal controlling an output cycle of an on-voltage of the scan signal. The data control signal CONT1 includes a horizontal synchronization start signal informing of the start of transmission of an image signal for one pixel row, a data load signal applying a plurality of data voltages to a plurality of data lines D1, D2, D3, . . . , Dn, and a data clock signal. The data control signal CONT1 may further include a polarity inversion signal for inverting a polarity of the data voltage for the common voltage of every frame, pixel row, or pixel array.

The timing controller 100 may output the generated data image signal DATA and data control signal CONT1 to the data driver 200 and the gate control signal CONT2 to the gate driver 300. The timing controller 100 may output the first data image signal to display the image to the data driver 200 at the first frame period, and the second data image signal to the data driver 200 to display the image at the second frame period.

The data driver 200 supplies the data voltage corresponding to each pixel to a unit of the pixel row. The data driver 200 generates a plurality of data voltages VD[1], VD[2], VD[3], . . . , VD[n] by using the received data image signal DATA and data control signal CONT1, and supplies the plurality of data voltages VD[1], VD[2], VD[3], . . . , VD[n] to the data lines D1, D2, D3, . . . , Dn by the unit of the pixel row. The data driver 200 converts the first data image signal into a plurality of data voltages VD[1], VD[2], VD[3], . . . , VD[n] corresponding to the odd rows during the first frame period to be supplied to the plurality of data lines D1, D2, D3, . . . , Dn. Also, the data driver 200 converts the second data image signal into a plurality of data voltages VD[1], VD[2], VD[3], . . . , VD[n] corresponding to the even rows during the second frame period to be supplied to the plurality of data lines D1, D2, D3, . . . , Dn. The data driver 200 may include a plurality of data driving Integrated Circuits (IC's) depending on the pixel resolution and the performance of the liquid crystal display 10.

The gate driver 300 respectively supplies a plurality of scan signals G[1], G[2], G[3], . . . , G[m] allowing an input of the plurality of data voltage VD[1], VD[2], VD[3], . . . , VD[n] to the plurality of pixels by the unit of the pixel row. The gate driver 300 may supply a plurality of scan signals G[1], G[2], G[3], . . . , G[m] generated depending on the received gate control signal CONT2 to the corresponding gate lines G1, G2, G3, . . . , Gm. The gate driver 300 may sequentially supply a same scan signal at the first frame period by the unit of two gate lines and may sequentially supply the scan signal to the even numbered gate lines G2, . . . , Gm at the second frame period. The gate driver 300 may include a plurality of gate driving ICs depending on the pixel resolution and the performance of the liquid crystal display 10.

The display unit 400 includes a plurality of pixels positioned at a plurality of odd rows and even rows that alternate. For example, the pixels $PX_{11}$, $PX_{12}$, $PX_{13}$, . . . , $PX_{1n}$, and $PX_{31}$, $PX_{32}$, $PX_{33}$, . . . , $PX_{3n}$ are positioned at the plurality of odd rows, and the pixels $PX_{21}$, $PX_{22}$, $PX_{23}$, . . . , $PX_{2n}$ are positioned at one of the plurality of even rows. In order to implement a color display, each pixel displays one of the primary colors depending on the pixel arrangement by spatial division, or alternately displays the primary colors by temporal division to recognize a desired color as a spatial or temporal sum of the primary colors. The primary colors may include red, green, blue, yellow, cyan, magenta, and the like.

The display unit 400 may display the first frame image at the first frame period and the second frame image at the second frame period. In the present embodiment, the first frame image and the second frame image are overlapped to display an original image.

Figure 1B:
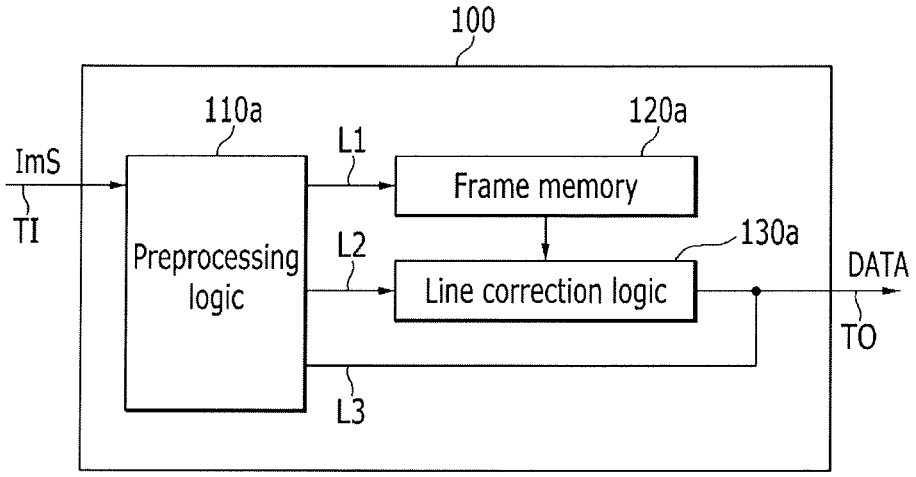
FIG. 1B illustrates a timing controller according to an embodiment of the inventive concept.

FIG. 1B is a view illustrating a timing controller according to an embodiment of the inventive concept.

Referring to FIG. 1B,the timing controller 100 according to an embodiment includes a preprocessing logic 110*a*, a frame memory 120*a*, and a line correction logic 130*a*.

The preprocessing logic 110*a* and the line correction logic 130*a* are shown in a divided state for a functional explanation, and may be manufactured by one digital signal processor, one microprocessor, or one IC (integrated circuit) by a person of ordinary skill in the art. The person of ordinary skill in the art may realize the preprocessing logic 110*a* and the line correction logic 130*a* through programming.

The frame memory 120*a* is a non-transitory memory having capacity sufficient to store the data image signal corresponding to at least one frame image. In the present embodiment, the frame memory 120*a* has a capacity sufficient to store the first data image signal. For example, the frame memory 120*a* may have capacity sufficient to store image information of 1920*540 resolution.

The input image signal ImS received through the input line TI may be converted into the data image signal DATA through the preprocessing logic 110*a*. The preprocessing logic 110*a* may convert the input image signal into a data image signal of a format that may be used by the data driver 200 to be suitable for specification(s) of the liquid crystal display 10 (e.g., a horizontal-vertical resolution of the pixel, a number and a specification of the data driving IC, a gray number to be displayed, etc.).

The preprocessing logic 110*a* may convert the input image signal ImS into the first data image signal during the first frame period. For example, if the display unit 400 of FIG. 1A has the plurality of pixels of 1920*1080 and the input image signal ImS includes the image information of the original image having a full-HD resolution of 1920*1080, the preprocessing logic 110*a* may extract the image information of 1920*540 corresponding to the odd row pixel of the display unit 400 to be converted into the first data image signal. As another example, the input image signal ImS includes the image information of 1920*540 that is a half of the original image, and if this image information corresponds to the odd row pixel of the display unit 400, the preprocessing logic 110*a* may directly convert the image information of 1920*540 into the first data image signal as it is.

With reference to FIG. 1B, the generated first data image signal is stored by the frame memory 120*a* through a path L1 and is output to the data driver 200 through the path L3 and the output line TO.

The preprocessing logic 110*a* may convert the input image signal ImS to be displayed during the second frame period into the second data image signal.

In the present embodiment, the second frame period follows the first frame period. For example, if the display unit 400 of FIG. 1A has the plurality of pixels of 1920*1080 and the input image signal ImS includes the image information of the original image of the full-HD resolution of 1920*1080, the preprocessing logic 110*a* may extract the image information of 1920*540 corresponding to the even row pixel of the display unit 400 to be converted into the second data image signal. As another example, if the input image signal ImS includes the image information of 1920*540 that is a half of the original image and the image information corresponds to the even row pixel of the display unit 400, the preprocessing logic 110*a* may directly convert the image information of 1920*540 into the second data image signal as it is.

In the present embodiment, the second data image signal may not be stored by the frame memory 120*a*. The second data image signal is input to the line correction logic 130*a* through the path L2. The line correction logic 130*a* receives the first data image signal from the frame memory 120*a* and corrects the second data image signal with reference to the first data image signal. The line correction logic 130*a* outputs the corrected second data image signal to the data driver 200 through the output line TO.

According to an embodiment of the inventive concept, the even row pixels are emitted corresponding to the plurality of data voltages VD[1], VD[2], VD[3], . . . , VD[n] into which the first data image signal is converted through the data driver 200 in the first frame period. The even row pixels are emitted corresponding to the plurality of data voltages VD[1], VD[2], VD[3], . . . , VD[n] into which the second data image signal is converted in the second frame period through the data driver 200. The line correction logic 130*a* may correct the second data image signal for a sum of the luminance displayed from the even row pixel in the first and second frame periods to be the luminance displayed by the original image. In this case, the line correction logic 130*a* may refer to a LUT (LookUp Table) recording the second data image signal that is corrected based on the first data image signal and the second data image signal. According to the inventive concept, there are various methods that may be considered when determining the second data image signal. For example, the second data image signal may not refer to the first data image signal and may be output through the output line TO without other correction processing. As another example, the second data image signal may be determined as the first data image signal corresponding to the odd row pixel next to each even row pixel. As another example, the corrected second data image signal may be determined as an average value of the second data image signal of the even row pixel and the first data image signal of the next odd row pixel.

Figure 1C:
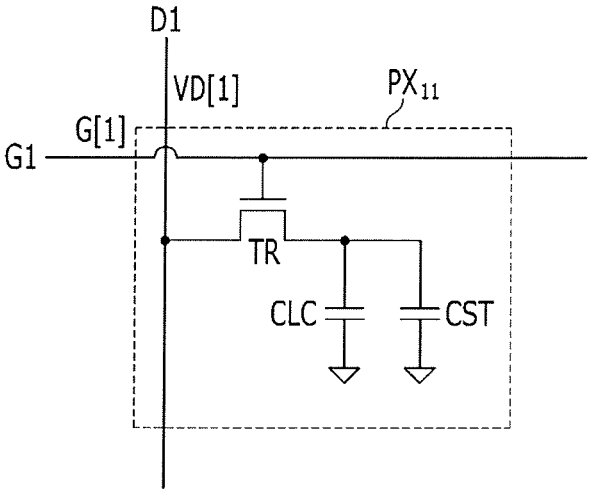
FIG. 1C illustrates one pixel of a display unit.

FIG. 1C illustrates one pixel of a display unit.

Referring to FIG. 1C,a circuit diagram of an exemplary pixel $PX_{11}$ is shown. The pixel $PX_{11}$ may include a transistor TR, a storage capacitor CST, and a liquid crystal capacitor CLC. The transistor TR includes a gate terminal connected to the first gate line G1 and an input terminal connected to the first data line D1. The storage capacitor CST provides additional capacitance to maintain the data voltage. The liquid crystal capacitor CLC is a capacitive component formed by a pixel electrode and a common electrode.

If a scan signal G[1] is supplied through the first gate line G1, the transistor TR is turned on, and the data voltage VD[1] supplied through the first data line D1 is written in the liquid crystal capacitor CLC and the storage capacitor CST through the turned-on transistor TR. A liquid crystal arrangement corresponding to the pixel $PX_{11}$ is determined corresponding to the written data voltage VD[1], and the light emitted from the backlight is modulated depending on the determined liquid crystal arrangement, thereby displaying the luminance corresponding to the data voltage VD[1].

The other pixels $PX_{12}$, $PX_{13}$, . . . , $PX_{1n}$, $PX_{21}$, $PX_{22}$, $PX_{23}$, . . . , $PX_{2n}$, $PX_{31}$, $PX_{32}$, $PX_{33}$, . . . , $PX_{3n}$, . . . , $PX_{m1}$, $PX_{m2}$, $PX_{m3}$, . . . , $PX_{mn}$ may have the same or similar circuit structure as the pixel $PX_{11}$ such that the description of the other pixels is omitted.

The present embodiment will now be described in additional detail with reference to FIGS. 2 to 6.

Figure 2:
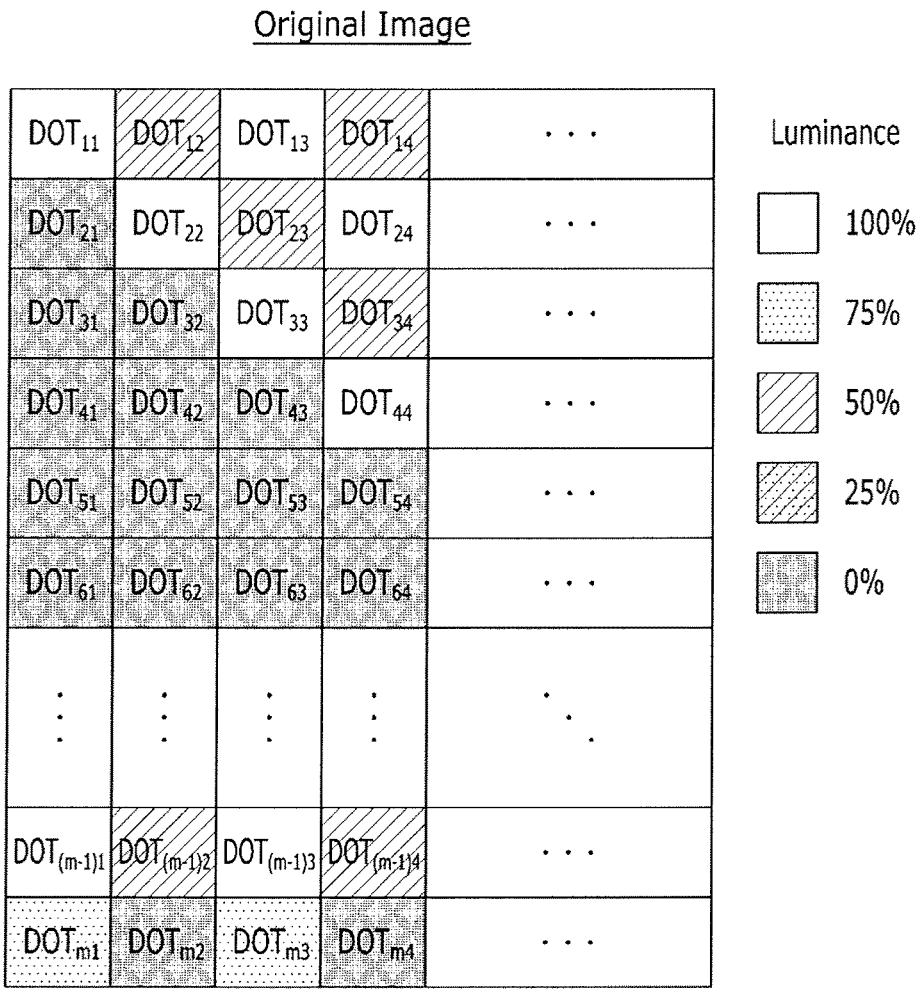
FIG. 2 illustrates an exemplary original image.

FIG. 2 illustrates an exemplary original image. The original image corresponds to the input image signal input from an external graphics controller.

Referring now to FIG. 2,the original image includes a plurality of dots $DOT_{11}$, $DOT_{12}$, $DOT_{13}$, $DOT_{14}$, . . . , $DOT_{21}$, $DOT_{22}$, $DOT_{23}$, $DOT_{24}$, . . . , $DOT_{31}$, $DOT_{32}$, $DOT_{33}$, $DOT_{34}$, . . . , $DOT_{41}$, $DOT_{42}$, $DOT_{43}$, $DOT_{44}$, . . . , $DOT_{51}$, $DOT_{52}$, $DOT_{53}$, $DOT_{54}$, . . . , $DOT_{61}$, $DOT_{62}$, $DOT_{63}$, $DOT_{64}$, . . . , $DOT_{(m-1)1}$, $DOT_{(m-1)2}$, $DOT_{(m-1)3}$, $DOT_{(m-1)4}$, . . . , $DOT_{m1}$, $DOT_{m2}$, $DOT_{m3}$, $DOT_{m4}$, . . . , and each dot has a luminance value to realize the original image.

In the present embodiment, it is assumed that each dot of the original image has any one among five luminance values of 100%, 75%, 50%, 25%, and 0%. The dots $DOT_{11}$, $DOT_{13}$, $DOT_{22}$, $DOT_{24}$, $DOT_{33}$, $DOT_{44}$, $DOT_{(m-1)1}$, and $DOT_{(m-1)3}$ have the luminance value of 100%, the dots $DOT_{m1}$ and $DOT_{m3}$ have the luminance value of 75%, the dots $DOT_{12}$, $DOT_{14}$, $DOT_{23}$, $DOT_{34}$, $DOT_{(m-1)2}$, and $DOT_{(m-1)4}$ have the luminance value of the 50%, and the dots $DOT_{21}$, $DOT_{31}$, $DOT_{32}$, $DOT_{41}$, $DOT_{42}$, $DOT_{43}$, $DOT_{51}$, $DOT_{52}$, $DOT_{53}$, $DOT_{54}$, $DOT_{61}$, $DOT_{62}$, $DOT_{63}$, $DOT_{64}$, $DOT_{m2}$, and $DOT_{m4}$ have the luminance value of 0%.

In the present embodiment, the first frame image (see FIG. 3B) is displayed on the display unit 400 at the first frame period, and the second frame image (see FIG. 4B) is displayed on the display unit 400 at the second frame period. The first and second frame images are overlapped on the display unit 400, thereby displaying the original image. In other words, as the second frame image is displayed after the first frame image is displayed, a user may recognize one original image configured with a luminance of which the luminance of the first frame image and the luminance of the second frame image are summed. The first frame period and the first frame image are referred to in FIGS. 3A and 3B, and the second frame period and the second frame image are referred to in FIGS. 4A and 4B.

Figure 3A:
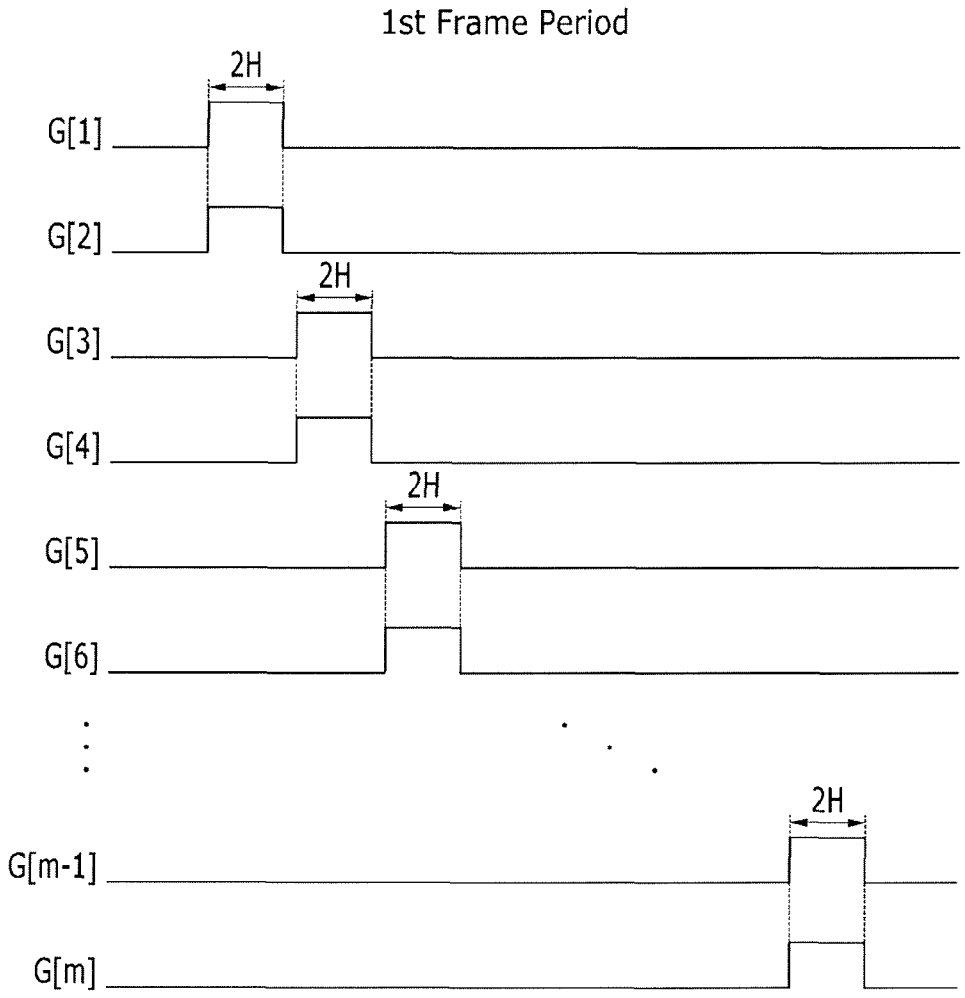
FIG. 3A is a timing diagram of a scan signal supplied at a first frame period.
Figure 3B:
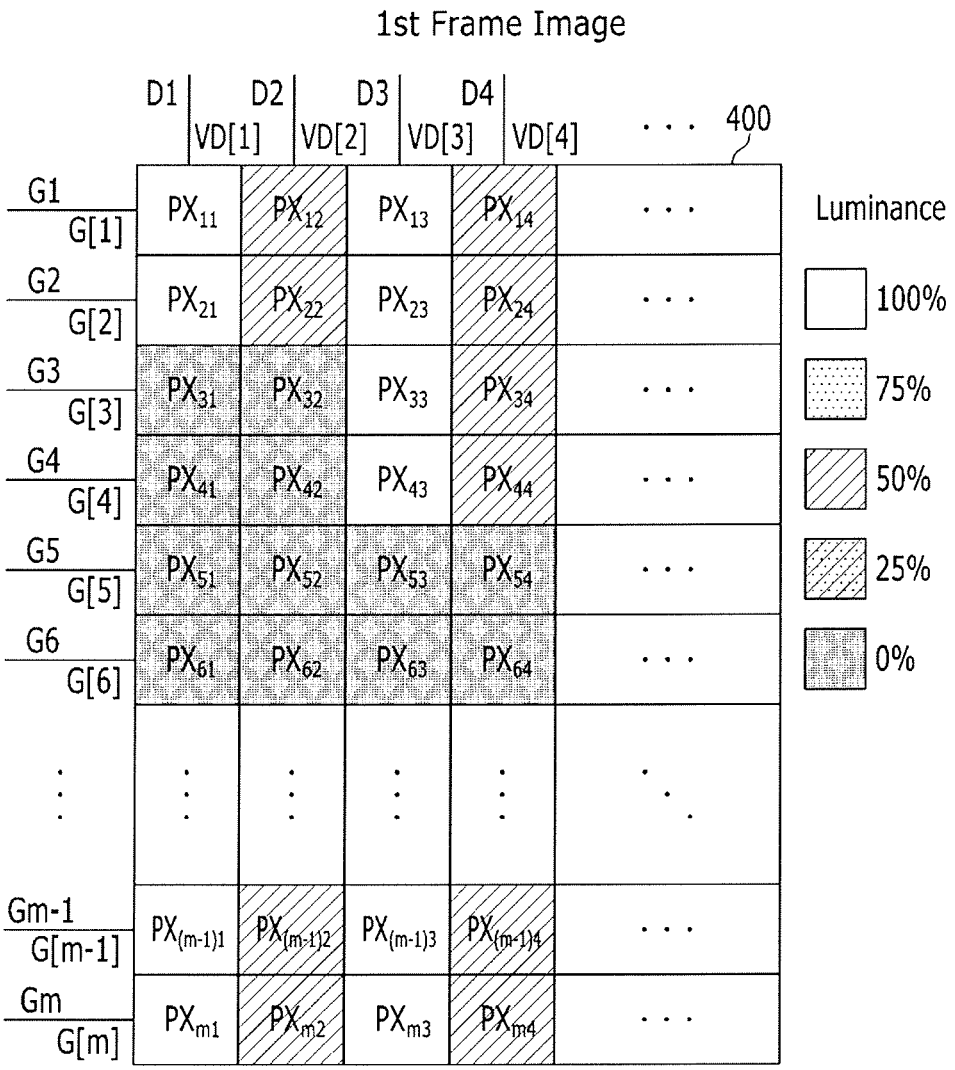
FIG. 3B is an illustration of a luminance of each pixel of a first frame image displayed at a first frame period.

FIG. 3A is a timing diagram of a scan signal being supplied at a first frame period, and FIG. 3B is a view to explain a luminance of each pixel of a first frame image displayed at a first frame period.

Referring to FIG. 3A,the timing at which the plurality of scan signals G[1], G[2], G[3], G[4], G[5], G[6], . . . , G[m−1], G[m] supplied to the plurality of gate lines G1, G2, G3, G4, G5, G6, . . . , Gm−1, Gm are supplied during the first frame period (1st Frame Period) is shown. Referring to FIG. 3B,the display unit 400 connected to the plurality of gate lines G1, G2, G3, G4, G5, G6, . . . , Gm−1, Gm and the plurality of data lines D1, D2, D3, D4, . . . is shown. FIG. 3B shows the first frame image displayed on the display unit 400 at the first frame period of FIG. 3A.

In the present embodiment, at the first frame period, the data driver 200 sequentially supplies the plurality of data voltages VD[1], VD[2], VD[3], VD[4], . . . corresponding to the pixels positioned in the odd row through the plurality of data lines D1, D2, D3, D4, . . . by the unit of the two pixel rows (e.g. a pair of pixel rows). For this, the gate driver 300 sequentially supplies the same scan signal at the first frame period by the unit of two pixel rows. For example, the gate driver 300 may substantially simultaneously supply the same scan signal at the first frame period to a pair of adjacent pixel rows, such as the pixels of the odd row corresponding to the plurality of data voltages VD[1], VD[2], VD[3], VD[4], . . . and the pixels of the even row adjacent to the corresponding odd row.

For example, the data driver 200 substantially simultaneously applies the plurality of data voltages VD[1], VD[2], VD[3], VD[4], . . . corresponding to the pixels $PX_{11}$, $PX_{12}$, $PX_{13}$, $PX_{14}$, . . . positioned at the first row to the data lines D1, D2, D3, D4, . . . .

Also, the gate driver 300 substantially simultaneously supplies the scan signal G[1] and G[2] to the two pixel rows $PX_{11}$, $PX_{12}$, $PX_{13}$, $PX_{14}$, . . . , $PX_{21}$, $PX_{22}$, $PX_{23}$, $PX_{24}$, . . . corresponding to two gate lines G1 and G2 to respectively connect the data lines D1, D2, D3, D4, . . . and the corresponding pixels $PX_{11}$, $PX_{12}$, $PX_{13}$, $PX_{14}$, . . . , $PX_{21}$, $PX_{22}$, $PX_{23}$, $PX_{24}$, . . . . The data line D1 and the pixels $PX_{11}$ and $PX_{21}$ are connected, the data line D2 and the pixels $PX_{12}$ and $PX_{22}$ are connected, the data line D3 and the pixels $PX_{13}$ and $PX_{23}$ are connected, and the data line D4 and the pixels $PX_{14}$ and $PX_{24}$ are connected, depending on the scan signals G[1] and G[2], through the gate lines G1 and G2.

Accordingly, the plurality of data voltages VD[1], VD[2], VD[3], VD[4], . . . corresponding to the pixels $PX_{11}$, $PX_{12}$, $PX_{13}$, $PX_{14}$, . . . of the first row are written to the pixels $PX_{11}$, $PX_{12}$, $PX_{13}$, $PX_{14}$, . . . positioned at the first row and the pixel $PX_{21}$, $PX_{22}$, $PX_{23}$, $PX_{24}$, . . . positioned at the second row. Again referring to FIG. 2, the data voltage VD[1] having the 100% luminance value corresponding to the dot $DOT_{11}$ is written to the pixels $PX_{11}$ and $PX_{21}$, the data voltage VD[2] having the 50% luminance value corresponding to the dot $DOT_{12}$ is written to the pixels $PX_{12}$ and $PX_{22}$, the data voltage VD[3] having the 100% luminance value corresponding to the dot $DOT_{13}$ is written to the pixels $PX_{13}$ and $PX_{23}$, and the data voltage VD[4] having the 50% luminance value corresponding to the dot $DOT_{14}$ is written to the pixels $PX_{14}$ and $PX_{24}$.

Next, in the horizontal period, the data driver 200 substantially simultaneously applies the plurality of data voltages VD[1], VD[2], VD[3], VD[4], . . . corresponding to the pixels $PX_{31}$, $PX_{32}$, $PX_{33}$, $PX_{34}$, . . . positioned at the third row to the data lines D1, D2, D3, D4, . . . .

Also, the gate driver 300 substantially simultaneously supplies the scan signals G[3] and G[4] to two pixel rows $PX_{31}$, $PX_{32}$, $PX_{33}$, $PX_{34}$, . . . , $PX_{41}$, $PX_{42}$, $PX_{43}$, $PX_{44}$, . . . corresponding to two gate lines G3 and G4 to connect the data lines D1, D2, D3, D4, . . . and the corresponding pixels $PX_{31}$, $PX_{32}$, $PX_{33}$, $PX_{34}$, . . . , $PX_{41}$, $PX_{42}$, $PX_{43}$, $PX_{44}$, . . . . Depending on the scan signals G[3] and G[4] supplied through the gate lines G3 and G4, the data line D1 and the pixels $PX_{31}$ and $PX_{41}$ are connected, the data line D2 and the pixels $PX_{32}$ and $PX_{42}$ are connected, the data line D3 and the pixels $PX_{33}$ and $PX_{43}$ are connected, and the data line D4 and the pixels $PX_{34}$ and $PX_{44}$ are connected.

Accordingly, the odd row data voltage corresponding to the pixels $PX_{31}$, $PX_{32}$, $PX_{33}$, $PX_{34}$, . . . is written to the pixels $PX_{31}$, $PX_{32}$, $PX_{33}$, $PX_{34}$, . . . positioned at the third row and the pixels $PX_{41}$, $PX_{42}$, $PX_{43}$, $PX_{44}$, . . . positioned at the fourth row. Again referring to FIG. 2, the data voltage VD[1] having the 0% luminance value corresponding to the dot $DOT_{31}$ is written to the pixels $PX_{31}$ and $PX_{41}$, the data voltage VD[2] having the 0% luminance value corresponding to the dot $DOT_{32}$ is written to the pixels $PX_{32}$ and $PX_{42}$, the data voltage VD[3] having the 100% luminance value corresponding to the dot $DOT_{33}$ is written to the pixels $PX_{33}$ and $PX_{43}$, and the data voltage VD[4] having the 50% luminance value corresponding to the dot $DOT_{34}$ is written to the pixels $PX_{34}$ and $PX_{44}$.

In a similar manner as discussed herein above, the plurality of data voltages VD[1], VD[2], VD[3], VD[4], . . . corresponding to the pixels $PX_{51}$, $PX_{52}$, $PX_{53}$, $PX_{54}$, . . . are written to the pixels $PX_{51}$, $PX_{52}$, $PX_{53}$, $PX_{54}$, . . . , $PX_{61}$, $PX_{62}$, $PX_{63}$, $PX_{64}$, . . . positioned at the fifth and sixth rows, and the plurality of data voltages VD[1], VD[2], VD[3], VD[4], . . . corresponding to the pixels $PX_{(m-1)1}$, $PX_{(m-1)2}$, $PX_{(m-1)3}$, and $PX_{(m-1)4}$ are written to the pixels $PX_{(m-1)1}$, $PX_{m-1)2}$, $PX_{(m-1)3}$, $PX_{(m-1)4}$, . . . , $PX_{m1}$, $PX_{m2}$, $PX_{m3}$, $PX_{m4}$, . . . positioned at the G(m−1) and the Gm rows.

Accordingly, at the first frame period, like FIG. 3B, the first frame image is displayed on the display unit 400.

Figure 4A:
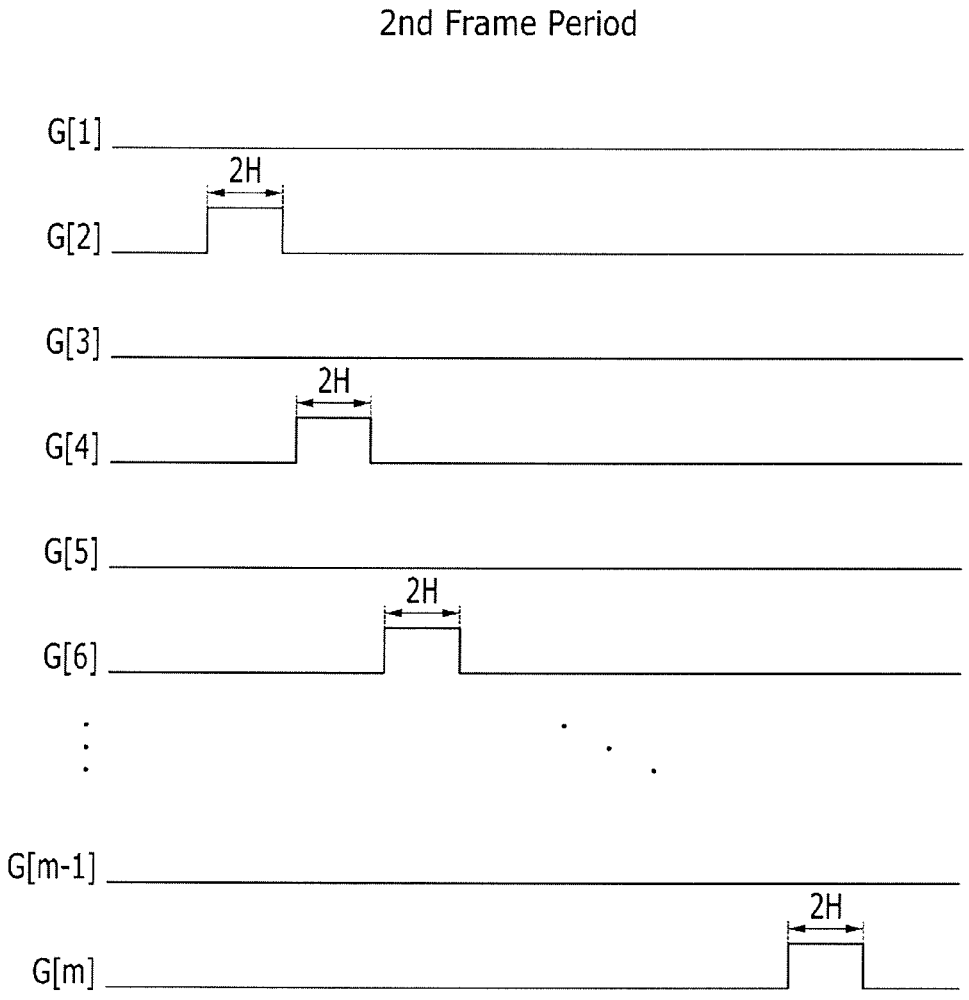
FIG. 4A is a timing diagram of a scan signal supplied at a second frame period.
Figure 4B:
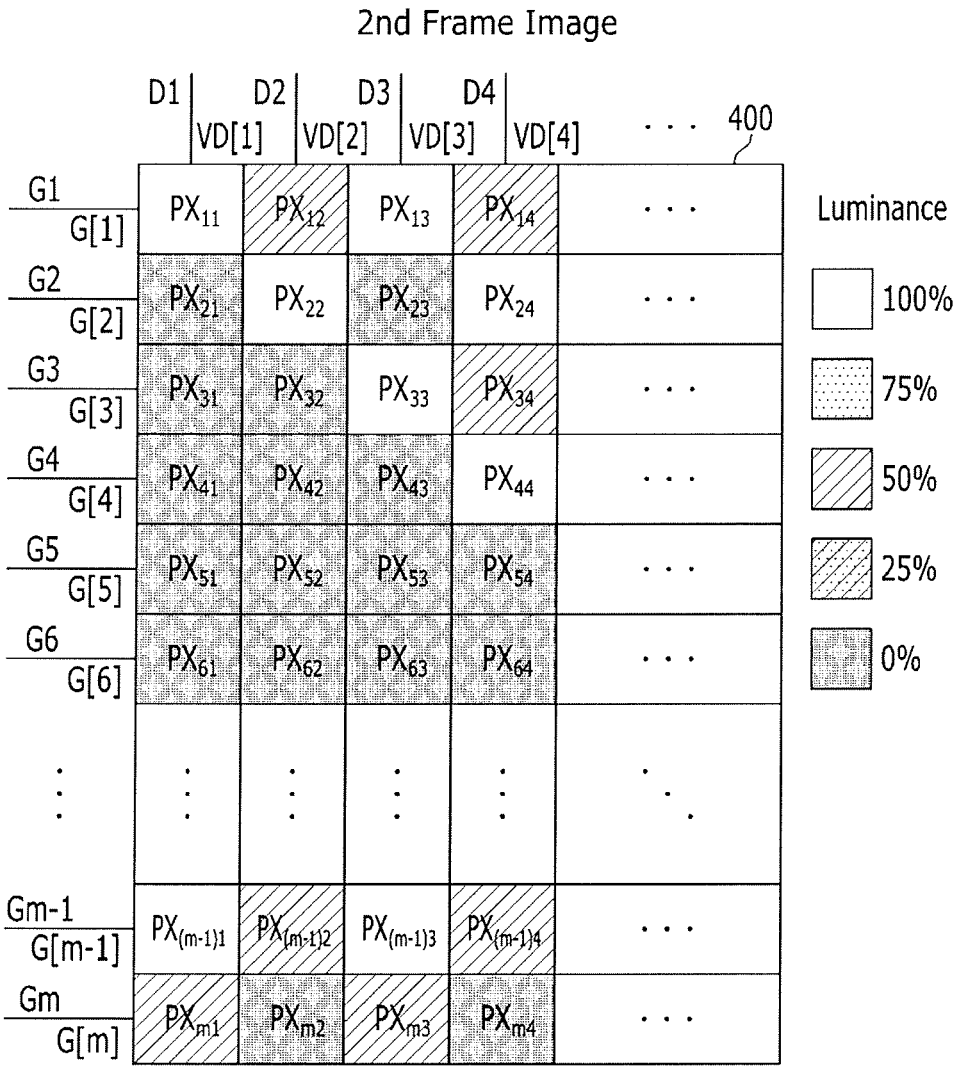
FIG. 4B is an illustration of a luminance of each pixel of a second frame image displayed at a second frame period.

FIG. 4A is a timing diagram of a scan signal being supplied at a second frame period, and FIG. 4B is a view to explain a luminance of each pixel of a second frame image displayed at a second frame period.

Referring to FIG. 4A,the timing at which the plurality of scan signals G[1], G[2], G[3], G[4], G[5], G[6], . . . , G[m−1], and G[m] applied to the plurality of gate lines G1, G2, G3, G4, G5, G6, . . . , G[m−1], and G[m] are supplied during the second frame period (2nd Frame Period) is shown. Referring to FIG. 4B, the display unit 400 in which the plurality of gate lines G1, G2, G3, G4, G5, G6, . . . , Gm−1, and Gm and the plurality of data lines D1, D2, D3, D4, . . . are connected is shown. FIG. 4B shows the second frame image displayed on the display unit 400 at the second frame period of FIG. 4A.

In the present embodiment, the data driver 200, at the second frame period, sequentially supplies the plurality of data voltages VD[1], VD[2], VD[3], VD[4], . . . corresponding to the pixels positioned at the even row through the plurality of data lines D1, D2, D3, D4, . . . by the unit of the pixel row. For example, the gate driver 300 supplies the scan signal to the corresponding pixel at the second frame period by the unit of one pixel row. The gate driver may supply the scan signal to the pixels of the even row corresponding to the plurality of data voltages VD[1], VD[2], VD[3], VD[4], . . . at the second frame period.

Unlike in the first frame period, the gate driver 300 in the second frame period does not supply the scan signals G[1], G[3], G[5], . . . , and G[m−1] to the odd row gate lines G1, G3, G5, . . . , and Gm−1 at the second frame period, the pixels $PX_{11}$, $PX_{12}$, $PX_{13}$, $PX_{31}$, $PX_{32}$, $PX_{33}$, $PX_{34}$, . . . , $PX_{51}$, $PX_{52}$, $PX_{53}$, $PX_{54}$, . . . , $PX_{(m-1)1}$, $PX_{(m-12}$, $PX_{(m-1)3}$, $PX_{(m-1)4}$, . . . positioned at the odd row may maintain the odd row data voltage during the second frame period.

Firstly, the data driver 200 substantially simultaneously applies the plurality of data voltages VD[1], VD[2], VD[3], VD[4], . . . corresponding to the pixels $PX_{21}$, $PX_{22}$, $PX_{23}$, $PX_{24}$, . . . positioned at the second row to the data lines D1, D2, D3, D4, . . . .

The gate driver 300 supplies the scan signal G[2] to one pixel row $PX_{21}$, $PX_{22}$, $PX_{23}$, $PX_{24}$, . . . corresponding to one gate line G2 to respectively connect the data lines D1, D2, D3, D4, . . . and the corresponding pixels $PX_{21}$, $PX_{22}$, $PX_{23}$, $PX_{24}$, . . . . Depending on the scan signal G[2] supplied through the gate line G2, the data line D1 and the pixel $PX_{21}$ are connected, the data line D2 and the pixel $PX_{22}$ are connected, the data line D3 and the pixel $PX_{23}$ are connected, and the data line D4 and the pixel $PX_{24}$ are connected.

Accordingly, the plurality of data voltages VD[1], VD[2], VD[3], VD[4], . . . corresponding to the pixels $PX_{21}$, $PX_{22}$, $PX_{23}$, $PX_{24}$, . . . are written to the pixels $PX_{21}$, $PX_{22}$, $PX_{23}$, $PX_{24}$, . . . positioned at the second row. The data voltage VD[1] having the 0% luminance value is written to the pixel $PX_{21}$, the data voltage VD[2] having the 100% luminance value is written to the pixel $PX_{22}$, the data voltage VD[3] having the 0% luminance value is written to the pixel $PX_{23}$, and the data voltage VD[4] having the 100% luminance value is written to the pixel $PX_{24}$. The plurality of data voltages VD[1], VD[2], VD[3], VD[4], . . . , as described in FIG. 1B, may depend on the second data image signal corrected by the line correction logic 130*a*.

Next, at the next horizontal period, the data driver 200 substantially simultaneously applies the plurality of data voltages VD[1], VD[2], VD[3], VD[4], . . . corresponding to the pixels $PX_{41}$, $PX_{42}$, $PX_{43}$, $PX_{44}$, . . . positioned at the fourth row to the data lines D1, D2, D3, D4, . . . .

Also, the gate driver supplies the scan signal G[4] to one pixel row ($PX_{41}$, $PX_{42}$, $PX_{43}$, $PX_{44}$, . . . corresponding to one gate line G4 to respectively connect the data lines D1, D2, D3, D4, . . . and the corresponding pixels $PX_{41}$, $PX_{42}$, $PX_{43}$, $PX_{44}$, . . . . Depending on the scan signal G[4] supplied through the gate line G4, the data line D1 and the pixel $PX_{41}$ are connected, the data line D2 and the pixel $PX_{42}$ are connected, the data line D3 and the pixel $PX_{43}$ are connected, and the data line D4 and the pixel $PX_{44}$ are connected.

Accordingly, the plurality of data voltages VD[1], VD[2], VD[3], VD[4], . . . corresponding to the pixels $PX_{41}$, $PX_{42}$, $PX_{43}$, $PX_{44}$, . . . are written to the pixels $PX_{41}$, $PX_{42}$, $PX_{43}$, $PX_{44}$, . . . positioned at the fourth row. The data voltage VD[1] having the 0% luminance value is written to the pixel $PX_{41}$, the data voltage VD[2] having the 0% luminance value is written to the pixel $PX_{42}$, the data voltage VD[3] having the 0% luminance value is written to the pixel $PX_{43}$, and the data voltage VD[4] having the 100% luminance value is written to the pixel $PX_{44}$. The plurality of data voltages VD[1], VD[2], VD[3], VD[4], . . . , as described in FIG. 1B, may depend on the second data image signal corrected by the line correction logic 130*a*.

In a similar manner as discussed hereinabove, the plurality of data voltages VD[1], VD[2], VD[3], VD[4], . . . corresponding to the pixels $PX_{61}$, $PX_{62}$, $PX_{63}$, $PX_{64}$, . . . are written to the pixels $PX_{61}$, $PX_{62}$, $PX_{63}$, $PX_{64}$, . . . positioned at the sixth row, and the plurality of data voltages VD[1], VD[2], VD[3], VD[4], . . . corresponding to the pixels $PX_{m1}$, $PX_{m2}$, $PX_{m3}$, $PX_{m4}$, . . . are written to the pixels $PX_{m1}$, $PX_{m2}$, $PX_{m3}$, $PX_{m4}$, . . . positioned at the G[m] row.

Accordingly, at the second frame period, as in FIG. 4B, the second frame image is displayed on the display unit 400.

In FIGS. 3A and 4A, when the scan signal is supplied, an enable level is a high level, and this is because the transistor TR of the pixel in FIG. 1C is an N type (a negative type) by way of example. If the transistor TR of the pixel of FIG. 1C were a P type (a positive type), the scan signal may be the enable level in the case of the low level. In the present embodiment, each horizontal period has a 2H length. Accordingly, even if the display unit 400 is driven with 240 Hz by using the display panel having a charge rate characteristic optimized to a 120 Hz frame speed, there is no problem in charging the voltage of each pixel.

Figure 5:
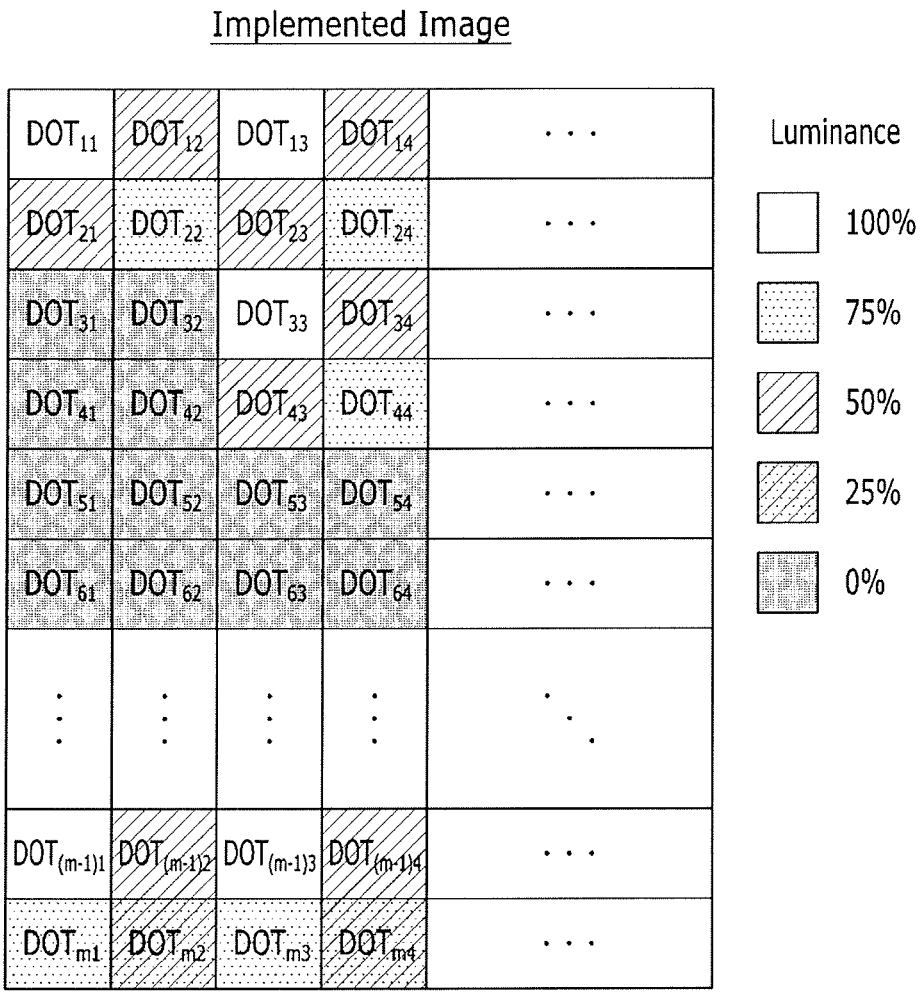
FIG. 5 illustrates a realization image in which a first frame image and a second frame image are overlapped.

FIG. 5 illustrates a realization image in which a first frame image and a second frame image are overlapped. In the following, the overlap of the luminance value is briefly described arithmetically for convenience of explanation, however a calculation process such as gamma correction depending on a luminance seen by an actual user may be further included. FIG. 2 is referenced to explain the illustration of FIG. 5.

An implemented image may be the same or similar to the original image of FIG. 2. The luminance of the odd row dots $DOT_{11}$, $DOT_{12}$, $DOT_{13}$, $DOT_{14}$, . . . , $DOT_{31}$, $DOT_{32}$, $DOT_{33}$, $DOT_{34}$, . . . , $DOT_{51}$, $DOT_{52}$, $DOT_{53}$, $DOT_{54}$, . . . , $DOT_{(m-1)1}$, $DOT_{(m-1)2}$, $DOT_{(m-1)3}$, $DOT_{(m-1)4}$, . . . of the implemented image maintains the same luminance value as the image information of the original image in the first and second frame periods, thereby having the same luminance as the corresponding odd row dot of the original image.

However, since the luminance of the even row dot of the implemented image is to overlap the first frame image and the second frame image, there may be a difference from the luminance of the original image. For example, the dot $DOT_{21}$ of the original image has the 0% luminance value, and the dot $DOT_{21}$ of the implemented image has the 50% luminance value by overlapping the 100% luminance value of the first frame image and the 0% luminance value of the second frame image. Also, the dot $DOT_{22}$ of the original image has the 100% luminance value, and the dot $DOT_{22}$ of the implemented image has the 75% luminance value by overlapping the 50% luminance value of the first frame image and the 100% luminance value of the second frame image. The implemented image is slightly different from the original image. However, although the dot $DOT_{22}$ of the original image is brighter than the dot $DOT_{21}$, this may be sufficiently represented by the dot $DOT_{22}$ that is brighter than the dot $DOT_{21}$ in the implemented image.

Also, it may be confirmed that the even row dots $DOT_{23}$, $DOT_{41}$, $DOT_{42}$, $DOT_{61}$, $DOT_{62}$, $DOT_{63}$, $DOT_{64}$, $DOT_{m1}$, and $DOT_{m3}$ of the implemented image are realized with the same luminance as the corresponding even row dots of the original image, respectively.

Figure 6:
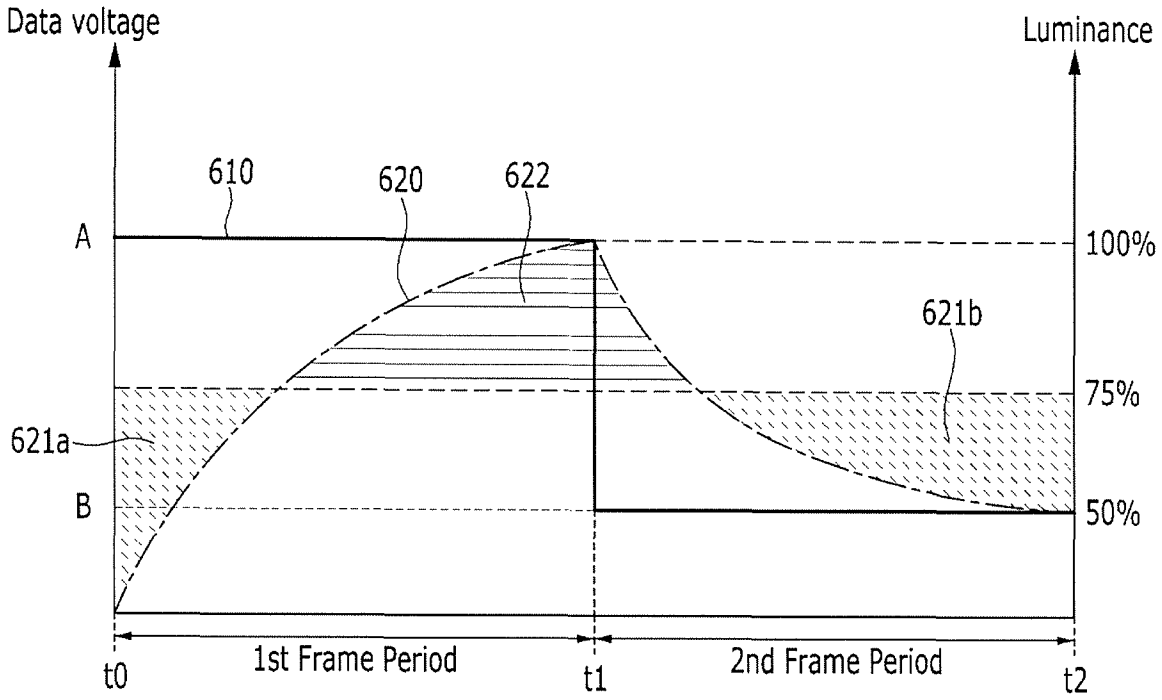
FIG. 6 illustrates a data voltage and a luminance during a process of determining an even row data voltage of each pixel of a second frame image.

FIG. 6 illustrates a process of determining an even row data voltage of each pixel of a second frame image.

Referring to FIG. 6, a data voltage 610 applied during the first frame period (1st Frame Period) and the second frame period (2nd Frame Period) to the pixel $PX_{m1}$ of FIG. 3B and FIG. 4B and luminance 620 corresponding thereto will be described.

A voltage value A is the odd row data voltage depending on the first data image signal, and a voltage value B is the even row data voltage depending on the corrected second data image signal.

The data voltage 610 having the voltage value A is applied at a starting point t0 of the first frame period, and the luminance 620 is gradually increased according to the reaction of the liquid crystal molecule and converges to 100%.

The data voltage 610 having the voltage value B is applied at the starting point t1 of the second frame period, and the luminance 620 is gradually decreased according to the reaction of the liquid crystal molecule and converges to 50% at a finishing point t2 of the second frame period.

Referring to the original image information of FIG. 2, the dot $DOT_{m1}$ corresponding to the pixel $PX_{m1}$ has the 75% luminance value. Accordingly, it is preferable that the second data image signal is corrected in the timing controller to output the even row data voltage having the voltage value B from the data driver so that sums of insufficient luminance parts 621*a* and 621*b* and an excessive luminance part 622 based on 75% are equal to each other.

Accordingly, the line correction logic 130*a* of FIG. 1B may previously store a LUT recording the corrected second data image signal for each case of having the first data image signal and the second data image signal as an input value, for the even row pixel $PX_{m1}$.

Resultantly, the 75% luminance value of the dot $DOT_{m1}$ of the original image of FIG. 2 is preferably realized with the same luminance value in the dot $DOT_{m1}$ of the implemented image of FIG. 5.

In FIG. 6, for convenience of explanation, the description for a polarity inversion driving method of the data voltage to prevent the degradation of the liquid crystal layer of the liquid crystal display is excluded. If the polarity inversion driving method of the frame unit is introduced, one of the voltage value A and the voltage value B has a negative value.

The above detailed descriptions with reference to the accompanying drawings are provided to assist a person of ordinary skill in the art with a comprehensive understanding of embodiments of the inventive concept as defined by the claims and their equivalents. The detailed description includes various specific details to assist in that understanding, but these are to be regarded as merely exemplary.

The apparatuses and methods of the disclosure can be implemented in hardware, and in part as firmware or via the execution of software or computer code in conjunction with hardware that is stored on a non-transitory machine readable medium such as a CD ROM, a RAM, a floppy disk, a hard disk, or computer code downloaded over a network originally stored on a remote recording medium or a non-transitory machine readable medium and stored on a local non-transitory recording medium for execution by hardware such as a processor, so that the methods described herein are loaded into hardware such as a general purpose computer, or a special processor or in programmable or dedicated hardware, such as an ASIC or FPGA. As would be understood in the art, the computer, the processor, microprocessor controller or the programmable hardware include memory components, e.g., RAM, ROM, Flash, etc., that may store or receive software or computer code that when accessed and executed by the computer, processor or hardware implement the processing methods described herein. In addition, it would be recognized that when a general purpose computer accesses code for implementing the processing shown herein, the execution of the code transforms the general purpose computer into a special purpose computer for executing the processing shown herein.

Accordingly, those of ordinary skill in the art will recognize that various changes and modifications of the embodiments described herein can be made without departing from the scope and spirit of the inventive concept. Therefore, the scope of the inventive concept shall be determined only according to the attached claims and the equivalents thereof.

What is claimed is:

1. A liquid crystal display comprising:

a display unit including a plurality of pixels in a plurality of first rows of pixels and a plurality of second rows of pixels that are alternately arranged;

a gate driver that supplies a same scan signal to the plurality of pixels of a first row and a second row adjacent to each other among the plurality of first rows of pixels and the plurality of second rows of pixels at a first frame period, and respectively supplies a plurality of scan signals to only the plurality of second rows of pixels in a second frame period subsequent to the first frame period; and a data driver configured to generate a plurality of data voltages that respectively correspond to the plurality of first rows of pixels at the first frame period and generate a plurality of data voltages respectively corresponding to the plurality of second rows of pixels at the second frame period.

2. The liquid crystal display of claim 1, wherein the data driver sequentially supplies a first row data voltage corresponding to the pixels positioned at the plurality of first rows by a unit of the pixel row at the first frame period, and sequentially supplies a second row data voltage corresponding to the pixels positioned at the plurality of second rows of pixels by a unit of the pixel row at the second frame period.

3. The liquid crystal display of claim 2, wherein the gate driver substantially simultaneously supplies the scan signal to the pixels of the first row corresponding to the first row data voltage and the pixels of the second row adjacent to the first row at the first frame period, and supplies the scan signal to the pixels of the second row corresponding to the second row data voltage at the second frame period.

4. The liquid crystal display of claim 3, wherein the pixels positioned at the plurality of first rows of pixels maintain the first row data voltage at the second frame period.

5. The liquid crystal display of claim 4, wherein the display unit displays a first frame image at the first frame period and a second frame image at the second frame period, and the first and second frame images arc overlapped to display an original image.

6. The liquid crystal display of claim 5, further comprising:

a timing controller configured to convert an input image signal received from the outside into a data image signal to be supplied to the data driver, wherein the data image signal includes a first data image signal corresponding to the first row data voltage and a second data image signal corresponding to the second row data voltage, and the timing controller generates the second data image signal with reference to the first data image signal.

7. The liquid crystal display of claim 6, wherein the timing controller generates the second data image signal so that a sum of a luminance displayed corresponding to the first row data voltage and a luminance displayed corresponding to the second row data voltage results in a luminance displayed by the original image at the second row pixel.

8. The liquid crystal display of claim 6, wherein the timing controller comprises:

a preprocessing logic to convert the input image signal into the data image signal of a format that is compatible with the data driver, a frame memory having a capacity to store the data image signal corresponding to at least one frame image, and a line correction logic that receives the first data image signal from the frame memory and corrects the second data image signal with reference to the first data image signal.

9. A method for driving a liquid crystal display, comprising:

supplying, by a data driver, a data voltage corresponding to each pixel by a unit of a pixel row;

supplying, by a gate driver, a scan signal allowing input of the data voltage to the pixel by the unit of the pixel row; and displaying, by a display unit, a display image corresponding to the data voltage including a plurality of first rows of pixels and second rows of pixels that are alternately arranged;

wherein the gate driver supplies a same scan signal to the plurality of pixels of a first row and a second row adjacent to each other among the plurality of first rows of pixels and the plurality of second rows of pixels at a first frame period, and respectively supplies a plurality of scan signals to only the plurality of second rows of pixels at a second frame period subsequent to the first frame period; and the data driver generates a plurality of data voltages respectively corresponding to the plurality of first rows of pixels at the first frame period and generates a plurality of data voltages respectively corresponding to the plurality of second rows of pixels at the second frame period.

10. The method of claim 9, wherein the supplying of the data voltage by the unit of the pixel row includes:

sequentially supplying the first row data voltage corresponding to the pixels positioned in the plurality of first rows of pixels at the first frame period by the unit of the pixel row; and sequentially supplying the second row data voltage corresponding to the pixels positioned in the plurality of second rows of pixels at the second frame period by the unit of the pixel row.

11. The method of claim 10, wherein the supplying of the scan signal by the unit of the row includes:

substantially simultaneously supplying the scan signal to the pixel of the first row corresponding to the first row data voltage and the pixel of the second row adjacent to the first row at the first frame period; and supplying the scan signal to the pixel of the second row corresponding to the second row data voltage at the second frame period.

12. The method of claim 11, wherein the pixels positioned in the plurality of first rows maintain the first row data voltage at the second frame period.

13. The method of claim 12, wherein the displaying of the display image corresponding to the data voltage includes:

displaying a first frame image at the first frame period; and displaying a second frame image at the second frame period;

wherein the first and second frame images are overlapped to display an original image.

14. The method of claim 13, further comprising:

converting an input image signal received from the outside into a data image signal through a timing controller to be supplied to the data driver;

wherein the data image signal includes a first data image signal corresponding to the first row data voltage and a second data image signal corresponding to the second row data voltage, and generating by the timing controller the second data image signal with reference to the first data image signal.

15. The method of claim 14, wherein the timing controller determines the second data image signal so that a sum of a luminance displayed corresponding to the first row data voltage and a luminance displayed corresponding to the second row data voltage results in a luminance displayed by the original image at the second row pixel.

16. A display device comprising:

a plurality of gate lines and a plurality of data lines;

a liquid crystal display including a plurality of pixels arranged in a plurality of first rows and second rows that alternate, and each pixel includes a switching clement connected to one or more of the plurality of gate lines and one or more of the plurality of data lines;

a gate driver that is configured at a first frame period to output to a pair of adjacent rows of pixels via at least one of the gate lines a first scan signal comprising one of the first rows of pixels and one of the second rows of pixels to generate a first frame image, and the gate driver outputs at a second frame period a second scan signal to one row of the pair of adjacent first and second rows of pixels to generate a second frame image;

a data driver that at the first frame period generates a plurality of data voltages respectively corresponding to the plurality of first rows of pixels, and the data driver generates at the second frame period a plurality of data voltages respectively corresponding to the plurality of second rows of pixels; and a timing controller configured to generate a first data image signal and a second data image signal, wherein the second data image signal is corrected using the first data image signal, wherein the data driver supplies by the plurality of data lines data voltages corresponding to the first and second rows of pixels.

17. The display device according to claim 16, wherein at the second frame period, one row of the pair of adjacent rows of pixels receives the second scan signal at the second frame period to generate the second frame in age, and the other row of the pair of adjacent rows of pixels maintains respective data voltages from the first frame period.

18. The display device according, to claim 17, wherein at the second frame period the data driver substantially simultaneously supplies the data voltages to the pixels of the one row of the pair of adjacent first and second rows of pixels.

19. The display device according to claim 17, wherein in the first frame period the gate driver outputs a respective scan signal to at least one other pair of adjacent first and second rows of pixels.

20. The display device according to claim 17, wherein the first frame image and the second frame image are overlapped to display an original image.

* * * * *